US005950044A

United States Patent [19]

Ashiya et al.

[11] Patent Number: 5,950,044

[45] Date of Patent: Sep. 7, 1999

[54] ELECTROPHOTOGRAPHIC APPARATUS AND IMAGE FORMING METHOD

[75] Inventors: Seiji Ashiya; Satoshi Shigezaki, both of Minami-Ashigara, Japan

[73] Assignee: Fuji Xerox Co., Ltd., Tokyo, Japan

[21] Appl. No.: 08/947,486

[22] Filed: Oct. 10, 1997

[30] Foreign Application Priority Data

Oct. 16, 1996 [JP] Japan ..... 8-273312

[51] Int. Cl.[6] ..... G03G 21/14; G03G 15/14; G03G 15/05

[52] U.S. Cl. ..... 399/76; 399/50; 399/66; 399/159; 399/168; 399/297; 430/56

[58] Field of Search ..... 399/38, 50, 66, 399/159, 168, 297, 301, 76, 77; 430/56

[56] References Cited

U.S. PATENT DOCUMENTS

| | | | |
|---|---|---|---|
| 5,225,878 | 7/1993 | Asano et al. . | |
| 5,289,234 | 2/1994 | Asano et al. . | |
| 5,446,527 | 8/1995 | Yasuda et al. . | |
| 5,576,810 | 11/1996 | Aita et al. . | |
| 5,731,122 | 3/1998 | Yoshida et al. | 430/126 |

FOREIGN PATENT DOCUMENTS

| | | |
|---|---|---|
| A-59-155851 | 9/1984 | Japan . |
| A-61-28557 | 2/1986 | Japan . |
| A-2-233769 | 9/1990 | Japan . |
| A-4-319967 | 11/1992 | Japan . |
| B2-5-55860 | 5/1993 | Japan . |
| A-7-20690 | 7/1995 | Japan . |

*Primary Examiner*—Richard Moses
*Attorney, Agent, or Firm*—Oliff & Berridge, PLC

[57] ABSTRACT

An electrophotographic apparatus includes an electrophotographic photosensitive member, a charging device, an image exposure device, a developing device, a transfer device, and a control device. The control device stops rotation of the electrophotographic photosensitive member after a region of the electrophotographic photosensitive member, which region opposes the transfer device at the time when operation of the transfer device is stopped while the rotation of the electrophotographic photosensitive member is not stopped, passes, by at least one revolution, a position opposing the charging device which is running. The electrophotographic apparatus requires no idle rotation, makes high speed processing possible, suppresses negative and positive ghosting, and suppresses variations in electric characteristics and in image densities between first and second copying operations, thereby enabling images of high quality to be prepared quickly and simply.

11 Claims, 6 Drawing Sheets

ELECTROPHOTOGRAPHIC APPARATUS AND IMAGE FORMING METHOD

BACKGROUND OF THE INVENTION

1. Field of the Invention

The present invention relates to an electrophotographic apparatus and an image forming method for reverse developing using an electrophotographic photosensitive member. More particularly, the present invention relates to an electrophotographic apparatus and an image forming method which require no idle rotation at the start of a copying operation, make high speed processing possible, suppress the generation of negative or positive ghosting, and suppress variations in electric characteristics and in image densities between first and second copying cycles, thereby enabling images of high quality to be prepared quickly and simply.

2. Description of the Related Art

An electrophotographic process invented by C. F. Carlson has been widely used in recent years not only in the fields of copying machines but also in various fields including the fields of printers and fax machines because of its excellent immediate processing ability and ability to prepare images having high quality and excellent storage stability. The electrophotographic process fundamentally comprises an image forming process and an initializing process. The image forming process includes uniformly charging an electrophotographic photosensitive member, forming an electrostatic latent image on the surface of the electrophotographic photosensitive member by image exposure corresponding to the original, making the electrostatic latent image visible by using a toner to form an image, transferring the toner image to a paper (through an intermediate transfer member in some cases), and fixing the image. The initializing process includes a step of removing the toner and charges remaining on the surface of the electrophotographic photosensitive member because the electrophotographic photosensitive member is repeatedly used.

Organic type photoconductive materials, which are non-polluting and have the advantages such as easy film formation and easy production, have been used in recent years as electrophotographic photosensitive members in place of inorganic type photoconductive materials such as selenium, arsenic/selenium alloy, cadmium sulfate, zinc oxide, and the like which have been conventionally used. Electrophotographic photosensitive members can be classified into a single layer type and a laminate type. Among these types, a laminate type photosensitive material comprising a charge generating layer and a charge transporting layer, which are laminated on an electroconductive support, has high sensitivity, can be selected from a wide variety of materials, is safe, possesses high produce ability, and is comparatively advantageous in terms of costs. Therefore, such a laminate type photosensitive material is very popularly used for the electrophotographic photosensitive member and is produced in a large amount at present.

Recently, the technology of digitally forming images, by which images of higher quality are obtained and by which storage and free editing of the input image are made possible, has come into wide use. Although devices for digitally forming images are limited to portions of color laser copiers, laser printers and LED printers which are output devices for word processors and personal computers, and the like, these digital systems have rapidly come to be used widely in the fields of ordinary copying machines which form images by analog processing.

When an image is formed digitally, image information is input into an electrophotographic photosensitive member after electric signals have been converted into optical signals in the case of directly using computer information which is electric signals, or, in the case of using information of an original, after reading information of the original as optical information, then converting the optical information into digital electric signals once, and then converting these digital electric signals again to optical signals. The image information is input into the electrophotographic photosensitive member as optical signals. For the input of such optical signals, laser light or LED light is usually used. At present, light: which is most frequently used for the input of the optical signals is near infrared light of an oscillation wavelength of 780 nm or 660 nm, or light of a long wavelength closing to these wavelengths.

The characteristic firstly required of an electrophotographic photosensitive member used when forming images digitally is sensitivity to light of these long wavelengths. In view of this, selection and application of various kinds of materials have been studied to obtain an electrophotographic photosensitive member having the above characteristic.

Among these various materials, phthalocyanine compounds have been widely studied and used in practice because their synthesis is relatively simple and many phthalocyanine compounds exhibit sensitivity to light of a long wavelength.

For example, a photosensitive material using titanyl phthalocyanine is disclosed in Japanese Patent Application Publication (JP-B) No. 5-55860, a photosensitive material using β-type indium phthalocyanine is disclosed in Japanese Patent Application Laid-Open (JP-A) No. 59-155351, a photosensitive material using X-type non-metal phthalocyanine is disclosed in Japanese Patent Application Laid-Open (JP-A) No. 2-233769, and a photosensitive material using vanadyloxy phthalocyanine is disclosed in Japanese Patent Application Laid-Open (JP-A) No. 61-28557.

In the case of digital formation of an image, a so-called reverse developing method in which a toner is made to adhere to portions irradiated with light to form an image, is often used to efficiently utilize light or to improve the resolution. In this reverse developing method, dark potential portions become white background portions and light potential portions become black background portions (image line portions).

An electrophotographic photosensitive member, for which transfer of an image has been completed, is subjected to the above-mentioned initializing process because it must be used for the next image formation. As a charge-removing method in this process, a method utilizing AC corona discharge, a method utilizing light, and the like are known. Among these charge-removing methods, a charge removing method using light is often used because this method can be performed using a simple apparatus and is not accompanied by the generation of harmful gasses such as ozone and the like which are generated when using AC corona discharge.

The present inventors formed an image by an image forming process utilizing the reverse developing method using a laminate-type electrophotographic photosensitive member comprising a charge generating layer containing a phthalocyanine compound. However, they found that this image forming method had a drawback in that electrons tended to remain in the charge generating layer after holes were first injected into the laminate-type electrophotographic photosensitive member, and the electrons acted as a kind of memory causing variations in potential.

The fundamentals of this phenomenon are assumed to be that the electrons remaining in the charge generating layer advance for some reason to the boundary between the charge generating layer and the charge transporting layer, thereby reducing a barrier height for injecting holes in a vicinity of the boundary. In fact, when using a laminate-type electrophotographic photosensitive member which comprises a charge generating layer containing a phthalocyanine compound, the potential of a portion exposed by light in the previous exposure cycle is higher than that of the surrounding portions within an exposed area in this exposure cycle because of the difference due to the presence or lack of exposure in the previous exposure cycle, whereby a so-called negative ghosting phenomenon occurs. Or, because the sensitivity of a portion exposed by light in the previous cycle is apparently higher, a so-called positive ghosting phenomenon, in which the portion exposed by light in the previous cycle protrudes as a black portion, is marked when forming an image whose entire surface is uniform in this exposure cycle.

There is the potential for such problems to occur in the case of using a laminate-type electrophotographic photosensitive member comprising a charge generating layer containing a phthalocyanine compound in an image forming process utilizing the reverse developing method.

Currently, in order to avoid such problems, an image forming process by a first rotation of an electrophotographic photosensitive member, in which the charging potential is decreased, is not used for actual image formation (idle rotation), but image forming processes by the second and subsequent rotations of the electrophotographic photosensitive member, in which the charging potential is stabilized, are used for actual image formation. In the case of a conventional reverse developing-type printer which has a relatively slow copying speed (for example, 10 or fewer A4 size sheets per minute), the above problems are not conspicuously exhibited since the charging device has a sufficient ability to control the charge. Further, even an image forming process, in which the first rotation of the electrophotographic photosensitive member is idle, is used without any particular trouble because the transfer of data from a computer and the like requires some time, and the like. However, when an original is directly copied using a digital copier or the like with a high copying speed, there is a problem that the image forming process, in which the first rotation of the electrophotographic photosensitive member is idle, presents a great obstacle to high speed operation.

In light of this situation, there is a demand for the development of an electrophotographic apparatus and an image forming method by which an image can be formed even from the first rotation of a laminate-type electrophotographic photosensitive member.

SUMMARY OF THE INVENTION

It is an object of the present invention to solve the above conventional problems and to attain the objects described below corresponding to the above demand. Specifically, an object of the present invention is to provide an electrophotographic apparatus and an image forming method for reverse developing, which require no idle rotation at the start of a copying operation of a laminate-type electrophotographic photosensitive member, make high speed processing possible, suppress the generation of negative or positive ghosting, and suppress variations in electric characteristics and in image densities between first and second copying operations, thereby enabling images of high quality to be prepared quickly and simply.

The present inventors have conducted various studies to eliminate the useless idle rotation at the start of a copying operation in the case of using an electrophotographic photosensitive member, which comprises a charge generating layer containing a phthalocyanine compound, in an electrophotographic process using a reverse developing method. Further, the present inventors have conducted various studies to eliminate ghosting and to stabilize variations in electric characteristics and image densities between first and second copying cycles. As a result, it was found that a method of terminating a job of one cycle (copy cycle) in an image forming process was important to solve the above problems. In the case where the method of terminating a job is directed to the condition in which the space charge inside of the electrophotographic photosensitive member is accumulated, because the release or dissipation of the space charge is not simple, the history of fatigue due to the accumulation of the space charge firmly remains in the electrophotographic photosensitive member to cause the above problems not only in cases where a job in a copy cycle is continued and the job is continued after an extremely short rest but also in cases where the job is suspended for one night or several days. Therefore, it was hypothesized that a method, in which the space charge was not allowed to remain within the electrophotographic photosensitive member just before the termination of the job, would be most effective to solve the above-mentioned problems. Further, the present inventors directed their attention to the adverse effects of a transfer charger which supplied a charge which was opposite in polarity to that of the charger used in reverse developing. It was hypothesized that the above problems could be solved if the effects of the transfer charger were restricted in an efficient manner.

The present invention is based on the above knowledge acquired by the present inventors.

Accordingly, an electrophotographic apparatus comprising:

- an electrophotographic photosensitive member provided with a photosensitive layer, which contains a phthalocyanine compound, on an electroconductive support;
- charging means for charging the electrophotographic photosensitive member;
- image exposure means for forming an image on the electrophotographic photosensitive member by exposure;
- developing means for reverse-developing the image on the electrophotographic photosensitive member;

transfer means for transferring the image formed on the electrophotographic photosensitive member; and control means for stopping rotation of said electrophotographic photosensitive member after a region of said electrophotographic photosensitive member, which region opposes said transfer means at the time when operation of said transfer means is stopped while the rotation of said electrophotographic photosensitive member is not stopped, passes, by at least one revolution, a position opposing said charging means which is running.

An image forming method comprising:

a charging step of charging, by using a charging means, an electrophotographic photosensitive member provided with a photosensitive layer, which contains a phthalocyanine compound, on an electroconductive support;

a latent image forming step of effecting image exposure by an image exposure means to form an electrostatic latent image;

a developing step of making the electrostatic latent image visible by a reverse-developing means to form an image on the electrophotographic photosensitive member;

and a transfer step of transferring the image formed on the electrophotographic photosensitive member by a transfer means, wherein the rotation of the electrophotographic photosensitive member is stopped after a region of the electrophotographic photosensitive member, which region opposes the transfer means at the time when operation of the transfer means is stopped while the rotation of the electrophotographic photosensitive member is not stopped, passes, by at least one revolution, a position opposing the charging means which is running.

In the electrophotographic apparatus and method of the present invention, the rotation of the electrophotographic photosensitive member is stopped after the region of the electrophotographic photosensitive member, which region opposes the transfer means at the time when the operation of the transfer means is stopped while the rotation of the electrophotographic photosensitive member is not stopped, passes, by at least one revolution, a position opposing the charging means which is running. Specifically, after a copy cycle is completed and the transfer step is finished, the last position of the electrophotographic photosensitive member at the time of completion of the transfer step is rotated one or more cycles, that is, the electrophotographic photosensitive member is rotated one or more revolutions. During this time, charging is carried out by using the charging means in an attempt to allow no electrons to remain in the photosensitive layer and to remove electrons as much as possible at the time when a series of copying cycles is finished. In this condition, the copy cycle is stopped.

Consequently, it is possible to remove and level the space charge in the photosensitive layer, and particularly in the charge generating layer. In this way, the adverse effects of transfer current, that is, ghosting and variations in electric characteristics between the first and second copying operations are greatly reduced so that the uniformity within the circumferential direction surface of the electrophotographic photosensitive member is ensured. Therefore, the occurrence of ghosting and variations in the electric characteristics in the early stages of a new copy cycle which is started next are efficiently suppress, whereby the copying process is remarkably improved.

In the electrophotographic apparatus of the present invention, an light charge-removing means may be provided between the transfer means and the charging means. With this structure, due to the control means, the region of the electrophotographic photosensitive member, which region opposes the transfer means at the time when the operation of the transfer means is stopped while the rotation of the electrophotographic photosensitive member is not stopped, is made to pass, by at least one revolution, a position opposing the light charge-removing means which is running. Further, in the image forming method of the present invention, an light charge-removing step may be provided between the transfer step and the charging step to optically remove charge from the photographic photosensitive member by the light charge-removing means. The region of the electrophotographic photosensitive member, which region opposes the transfer means at the time when the operation of the transfer means is stopped while the rotation of the electrophotographic photosensitive member is not stopped, is controlled so as to be made to pass, by at least one revolution, a position opposing to the light charge-removing means which is running.

In accordance with this method, the electrophotographic photosensitive member which has undergone the transfer step can be subjected not only to charge treatment by the charging means, but also to light charge-removing treatment by the light charge-removing means. Flow of carriers in the photosensitive layer occurs more efficiently so that it is possible to remove and to level the space charge sufficiently.

DESCRIPTION OF THE PREFERRED EMBODIMENTS

Figure 1:
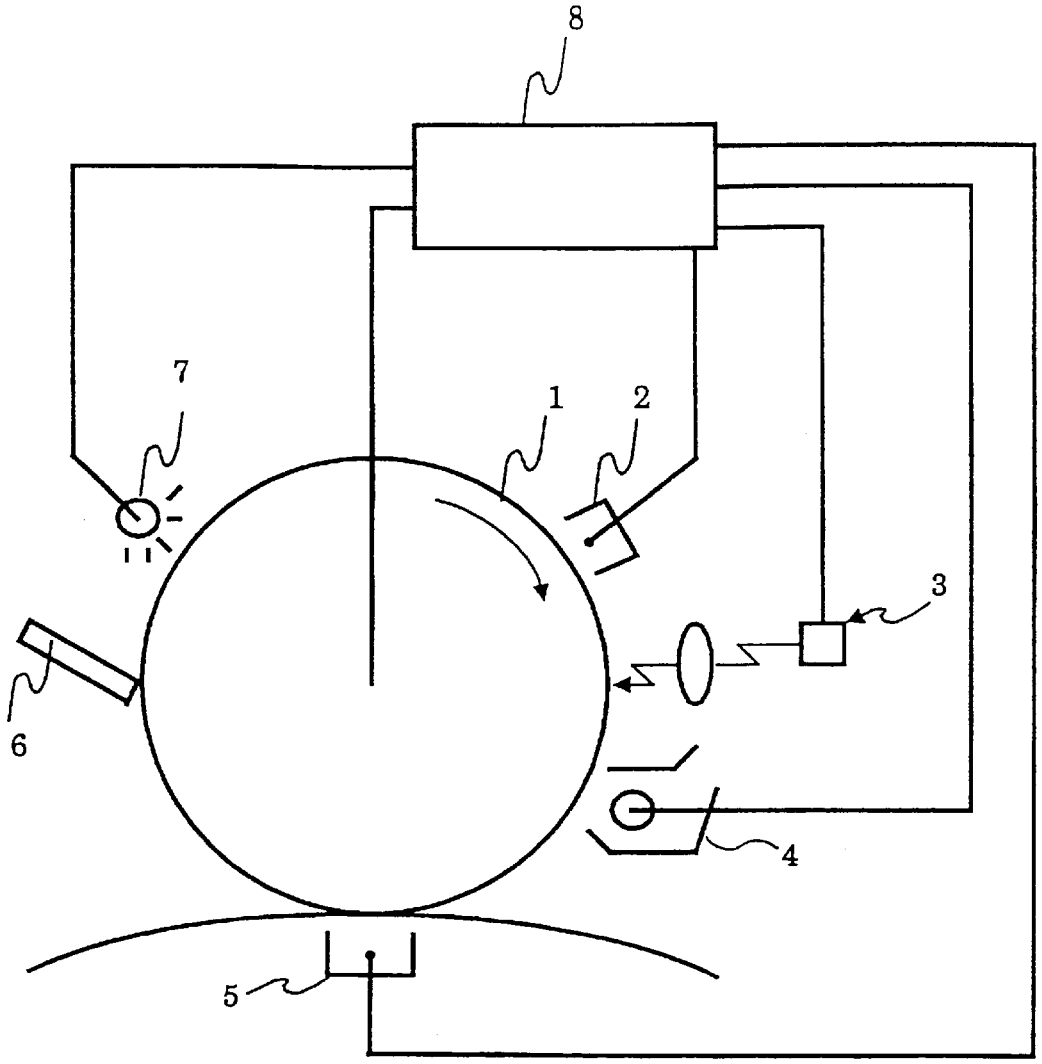
FIG. 1 is a view for explaining an embodiment of an electrophotographic apparatus of the present invention.

An electrophotographic photosensitive member and image forming method of the present invention will now be explained in detail with reference to the drawings.

The electrophotographic photosensitive member used in the present invention comprises a photoconductive layer (photosensitive layer) disposed on an electroconductive support. Although the electrophotographic photosensitive member may be a single layer type, a function-separated, laminate type electrophotographic photosensitive member is preferably used in the present invention.

Examples of materials used as the electroconductive support include metal materials such as aluminum, aluminum alloys, stainless steel, copper, nickel, and the like, polyester films on which aluminum is vapor-deposited, and paper.

A barrier layer which is conventionally known and usually used may be provided between the electroconductive support and the photoconductive layer. Examples of such a barrier layer include inorganic layers made of inorganic materials such as aluminum anode oxide coat, aluminum oxide, aluminum hydroxide, and the like; organic layers made of, for example, resins such as polyvinyl alcohol, casein, polyvinyl pyrrolidone, polyacrylic acid, celluloses, gelatin, starch, polyurethane, polyimide, polyamide, and the like; layers of organic metal compounds such as silane coupling agents, organic zirconium, and the like; and mixtures of these. These barrier layers may contain metals such as aluminum, steel, tin, zinc, titanium, and the like or electroconductive or semiconductive microparticles of metal oxides or the like.

Examples of the photoconductive layer used for the laminate-type electrophotographic photosensitive member are at least a charge generating layer containing a charge generating material and a charge transporting layer containing a charge transporting material.

Examples of the charge-generating material include chloride-coordinated phthalocyanines such as non-metal phthalocyanines, and the following metals oxides thereof: copper chloride indium, gallium chloride, tin, oxytitanium, zinc, vanadium, and the like. Among these, from the standpoints of photosensitivity, stability of electric properties, and image quality, it is preferable to use at least one compound selected from the group consisting of non-metal phthalocyanine, phthalocyanines of gallium halides such as chlorogallium and the like, phthalocyanines of tin halides such as dichlorotin and the like, hydroxygallium phthalocyanine, oxytitanyl phthalocyanine, phthalocyanines of indium halides such as chloroindium and the like, and vanadyl phthalocyanine.

A plurality of these center metals may be used as a mixed crystal or as a single compound.

The charge generating layer may include charge generating materials other than phthalocyanine to alter the spectral sensitivity and to improve the electric characteristics such as charging ability, residual potential, and the like. Examples of such a charge generating material include selenium and its alloys, arsenic-selenium, cadmium sulfate, zinc oxide, other inorganic photoconductive materials, azo pigment, quinacridone, polycyclic quinone, pyrylium salts, thiapyrylium salts, indigo, thioindigo, anthoanthrone, pyranthrone, cyanine, and the like.

The average particle diameter of the charge generating material is preferably 1 $\mu$m or less, more preferably 0.5$\mu$m or less, and most preferably 0.3 $\mu$m or less.

Examples of a binder used for the charge generating layer are polyvinyl acetate, polyacrylate, polymethacrylate, polyester, polycarbonate, polyvinyl acetoacetal, polyvinyl propional, polyvinyl butyral, phenoxy resins, epoxy resins, urethane resins, cellulose ester, cellulose ether, and the like.

The content of the charge generating material in the charge generating layer is generally from 30 to 500 parts by weight with respect to 100 parts by weight of the binder.

The thickness of the charge generating layer is generally from 0.1 to 2 $\mu$m and preferably from 0.15 to 0.8 $\mu$m.

Various additives such as a leveling agent for improving applicability, antioxidants, sensitizers, and the like may be added to the charge generating layer as needed.

The charge generating layer may be a layer in which microparticles of the charge generating material are bonded with the binder in the condition of being dispersed in the binder, or may be a vapor-deposited film of the charge generating material.

Examples of the charge transporting material include electron attracting materials such as 2,4,7-trinitrofluorenone, tetracyanoquinodimethane, and the like; and electron donating materials including heterocyclic compounds such as carbazole, indole, imidazole, oxazole, pyrazole, oxadiazole, pyrazoline, thiadiazole and the like, aniline derivatives, hydrazone compounds, aromatic amine derivatives, stilbene derivatives, polymers containing a group consisting of these compounds at the principal chain or side chains, and the like.

The charge transporting layer is formed in a state in which the charge transporting material is bonded with the binder.

Examples of materials used as the binder used in the charge transporting layer include vinyl polymers such as polymethyl methacrylate, polystyrene, polyvinyl chloride, and the like and copolymers thereof, polycarbonate, polyester, polyester carbonate, polysulfone, polyimide, phenoxy, epoxy, and silicon resins and the like, and partially cross-linked and cured products thereof.

The content of the charge transporting material in the charge transporting layer is generally from 30 to 200 parts by weight and preferably from 40 to 150 parts by weight with respect to 100 parts by weight of the binder.

The thickness of the charge transporting layer is generally from 5 to 50 $\mu$m and preferably from 10 to 45 $\mu$m.

Known additives such as plasticizers, antioxidants, UV absorbers, leveling agents, or the like may be added to the charge transporting layer as required to improve the film forming ability, flexibility, and applicability.

The outermost layer of the electrophotographic photosensitive layer may be provided on the photoconductive layer. Examples of the outermost layer are an over coating layer mainly formed of a conventionally known thermoplastic or heat-curable polymer, and the like.

In the present invention, materials which are highly polymerized by curing a high polymer type charge transporting material or a reactive, low polymer type charge transporting material having a charge transporting function may be used for the charge transporting layer or the over coating layer.

When each of the above-mentioned layers is formed, known methods may be used. For example, a coating solution prepared by dissolving or dispersing, in a solvent, materials to be added to each layer may be applied in order, followed by drying and the like.

The above-described electrophotographic photosensitive member is optimally used for the electrophotographic apparatus and the image forming method of the present invention.

The image forming method of the present invention comprises a charging step of charging an electrophotographic photosensitive member by a charging means; a latent image forming step of effecting image exposure by an image exposure means to form an electrostatic latent image; a developing step of making the latent image visible by a reverse-developing means to form an image on the photosensitive member; and a transfer step of transferring the image by a transfer means. The image forming method of the present invention may also comprise as needed an light charge-removing step for removing the charge of the electrophotographic photosensitive member by using an light charge-removing means.

Although the image forming method of the present invention can be performed according to a general process, the method can be implemented by using the electrophotographic apparatus of the present invention which is described below.

The electrophotographic apparatus of the present invention comprises a charging means for charging an electrophotographic photosensitive member; an image exposure means carrying out image exposure; a developing means for reverse-developing the image on the photosensitive member; a transfer means for transferring the image formed on the photosensitive member; and a control means for controlling the operations of these means. The electrophotographic apparatus of the present invention further comprises an light charge-removing means as needed.

The above charging may be, for example, contact charging using an electroconductive roller or brush, scorotron charging or corotron charging utilizing corona discharge, and the like. These charging methods are optimally carried out by the charging means used in the electrophotographic apparatus of the present invention which is described below.

The charging means is not particularly limited, and conventionally known chargers such as a contact-type charger using an electroconductive roller or an electroconductive brush, a scorotron charger or a corotron charger utilizing corona discharge, or the like can be used. Among these, the contact-type charger is preferable because of its excellent charge compensation ability.

The electrophotographic photosensitive member is charged by, for example, such a charging means so that it usually has a voltage ranging from −300 to −1000 V.

Image exposure can be carried out by using a known light source, for example, semiconductor laser light, LED light, liquid crystal shutter light, or the like. Image exposure is optimally carried out by the image exposure means used in the electrophotographic apparatus of the present invention.

The exposure means is not particularly limited, and it is preferable to use an optical device or the like capable of forming a desired image, for example, on the surface of the electrophotographic photosensitive member by using a light source of semiconductor laser light, LED light, liquid crystal shutter light, or the like.

The reverse-developing can be performed according to a general method of contacting or non-contacting, for example, a magnetic or non-magnetic one-component type developer or two-component developer, so as to develop an image. The reverse-developing is optimally realized by the developing means used in the photographic apparatus of the present invention.

The developing means is not particularly limited, and examples thereof are developing apparatuses and the like which have a function of applying a one-component developer or two-component developer to the electrophotographic photosensitive member by using a brush or a roller.

The transfer may be transfer by corona discharge, contact transfer by using a transfer roller, or the like. The transfer is optimally effected by the transfer means used in the electrophotographic apparatus of the present invention.

The transfer means is not particularly limited, and conventionally known transfer chargers such as a contact-type transfer charger using a transfer roller, a scorotron transfer charger or corotron transfer charger utilizing corona discharge, or the like can be used. Among these, the contact-type transfer charger is preferable because of its excellent transfer charge compensation ability.

In the present invention, an embodiment in which at least one of the charging means and the transfer means is a contact-type charger (including a contact-type transfer charger) is preferable in view of the charge compensation ability.

Light charge-removal can be carried out by using a conventionally known light such as white light of a tungsten lamp for example, red light of an LED light for example, or the like. Light charge-removal is optimally carried out by the light charge-removing means in the electrophotographic apparatus of the present invention which will be described below.

The light charge-removing is not particularly limited. Examples thereof include an light charge-removing device and the like having a function of irradiating the electrophotographic photosensitive member with light such as white light of a tungsten lamp for example, red light of an LED light for example, or the like.

The intensity of the illuminated light in the light charge-removing step is set to be from several times to 30 times the amount of light expressing the half-value exposure sensitivity of the electrophotographic photosensitive member.

In the image forming method of the present invention, the rotation of the electrophotographic photosensitive member is stopped after a region of the electrophotographic photosensitive member, which region opposes the transfer means at the time when the operation of the transfer means is stopped without the rotation of the electrophotographic photosensitive member being stopped, passes, by at least one revolution, a position opposing the charging means which is running. These operations are optimally controlled by the control means used in the electrophotographic apparatus of the present invention.

Figure 5:
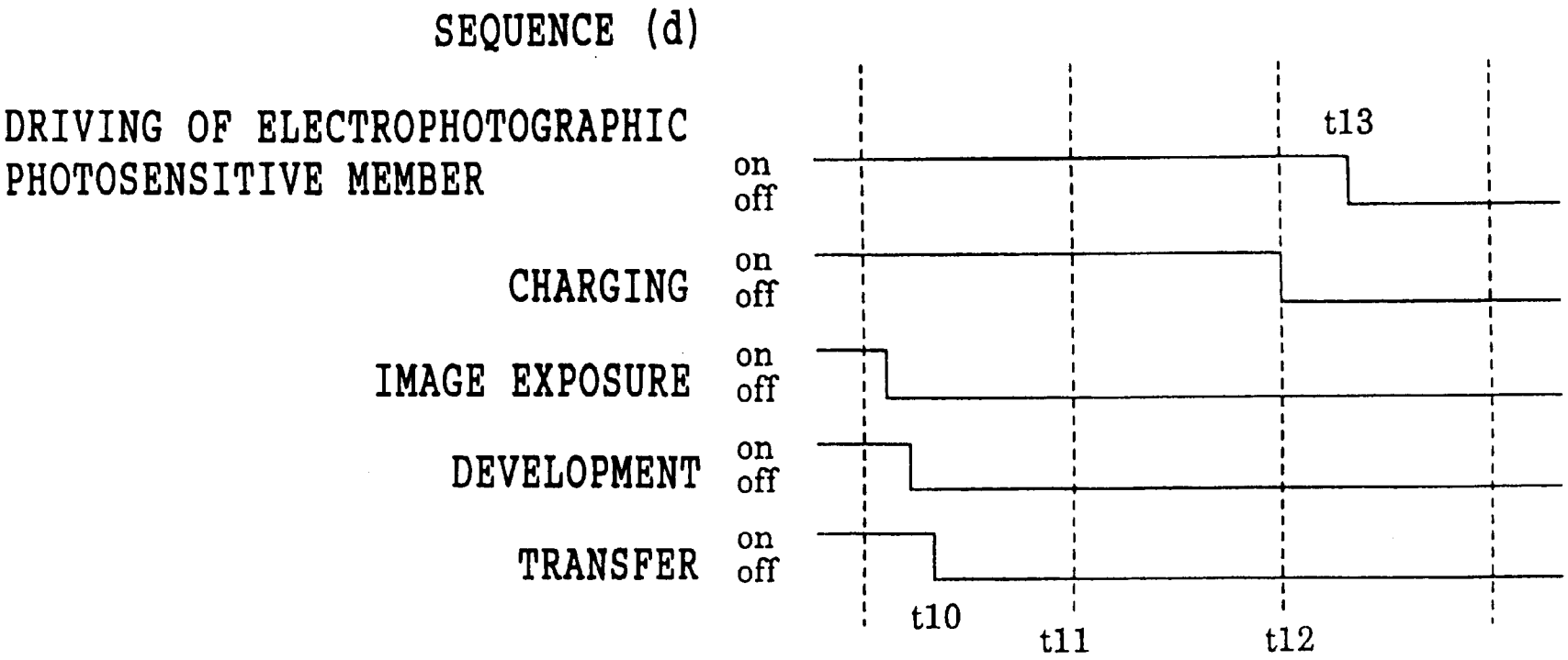
FIG. 5 is a view for explaining an embodiment of a control mode (another sequence of the present invention) of a control mean.

The control means has the function of controlling the operations of the electrophotographic photosensitive member and each of the charging means, image exposure means, developing means, transfer means, and the like, so as to stop the rotation of the electrophotographic photosensitive member after a region of the electrophotographic photosensitive member, which region opposes the transfer means at the time when the operation of the transfer means is stopped without the rotation of the electrophotographic photosensitive member being stopped, passes, by at least one revolution, a position opposing the charging means which is running. A computer control unit capable of controlling the operations of these means so that these means work, for example, in accordance with the mode shown in FIG. 5 may be used as the control means. In FIG. 5, each portion disposed between vertical lines means a range passed by one revolution of the electrophotographic photosensitive member.

The electrophotographic apparatus and image forming method of the present invention include an image forming process in which the rotation of the electrophotographic photosensitive member is stopped after a region of the electrophotographic photosensitive member, which region opposes the transfer means at the time when the operation of the transfer means is stopped without the rotation of the electrophotographic photosensitive member being stopped, passes, by at least one revolution, a position opposing the charging means which is running. For example, a case where the rotation of the electrophotographic photosensitive member is stopped for an instant after the image forming process is finished is included in the electrophotographic apparatus and image forming method of the present invention.

In the case where the electrophotographic apparatus includes the light charge-removing means between the transfer means and the charging means, it is desirable that the control means possesses the function of controlling the operations of each of the means so that the region of the electrophotographic photosensitive member, which region opposes the transfer means at the time when the operation of the transfer means is stopped without rotation of the electrophotographic photosensitive member being stopped, is allowed to pass, by at least one revolution, a position opposing the light charge-removing means which is running.

Figure 2:
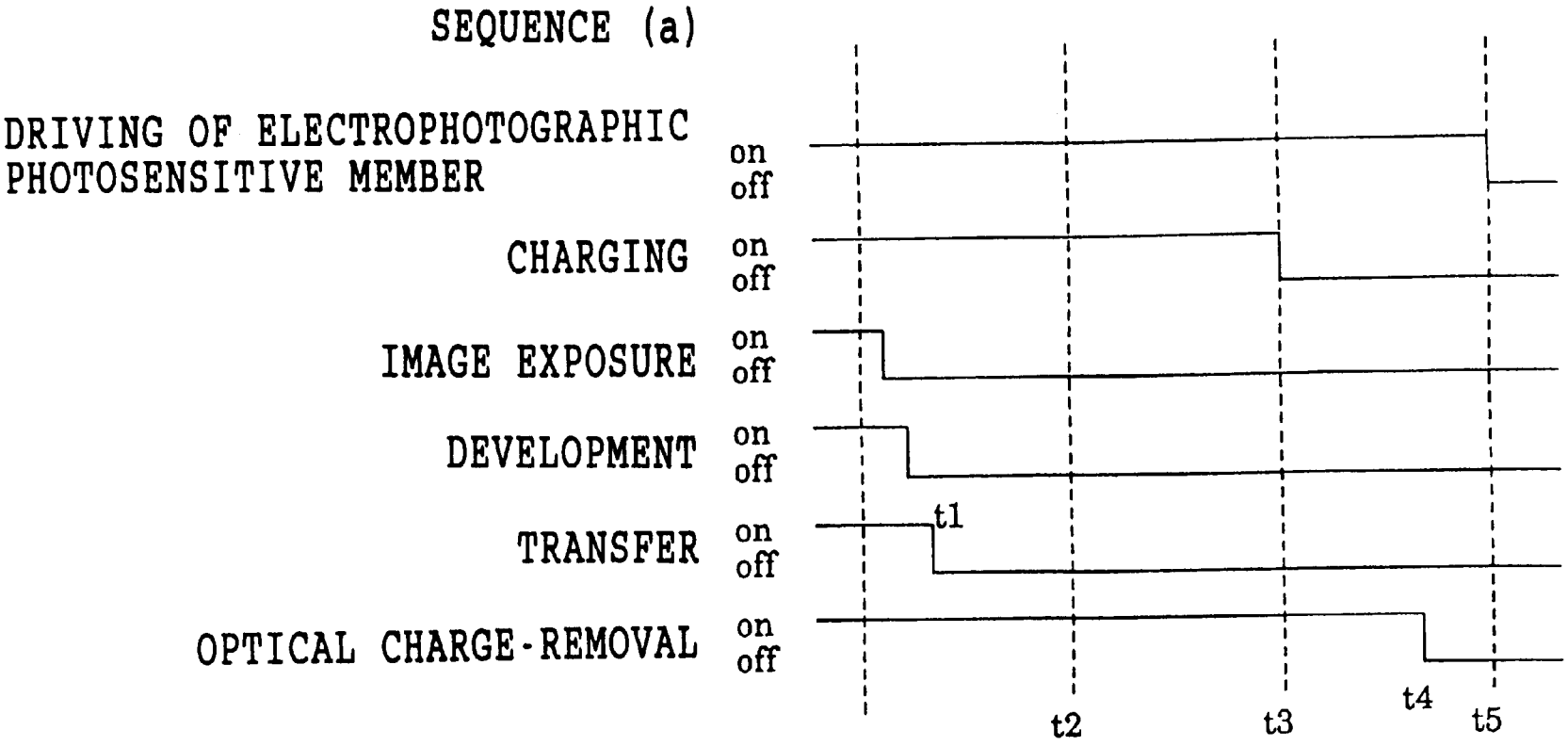
FIG. 2 is a view for explaining an embodiment of a control mode (a sequence of the present invention) of a control means.

A computer control unit or the like capable of controlling the operations of these means so that these means work, for example, in accordance with the mode shown in FIG. 2 may be used as the control means. In FIG. 2, each portion disposed between vertical lines means a range passed by one revolution of the electrophotographic photosensitive member.

A copying machine is illustrated in FIG. 1 as an embodiment of the electrophotographic apparatus of the present invention. In the copying machine, a charger (charging means) 2, an image exposure unit (image exposure means) 3, a developing unit (developing means) 4, a transfer charging unit (transfer means) 5, a cleaning blade 6, and an light charge-removing unit (light charge-removing means) 7 are disposed in that order in the direction of rotation of a laminate-type electrophotographic photosensitive member 1. Further, an unillustrated control unit (control means) for controlling the operations of these units (means) is provided.

EXAMPLES

The present invention will be explained in further detail by way of the following Examples, which are not intended to limit the present invention.

Example 1 and 2 and Comparative Examples 1 to 5

Production of Electrophotographic Photosensitive Member

Production of Electroconductive Support

Firstly, in accordance with the method described in Japanese Patent Application Laid-Open (JP-A) No. 2-87154, wet honing treatment of an aluminum pipe was carried out as follows. A mirror-finished-surface aluminum pipe of 84 mm diameter and 340 mm length was prepared. This pipe was subjected to wet honing treatment using a liquid honing machine. 10 kg of a polishing agent (Green Dethick GC #400, manufactured by Showa Denko K.K.) was suspended in 40 liters of water. This suspension was fed to a gun by a pump at 6 liters/minute. The aluminum pipe was moved in the axial direction and rotated at 120 rpm while the solution was sprayed onto the aluminum pipe at a velocity of 60 mm/minute together with air at a pressure of 0.85 kgf/cm$^2$. At this time, the average roughness Ra along the center line of the pipe product was 0.16 $\mu$m. The product thus obtained was used as the electroconductive support of the electrophotographic photosensitive member.

Formation of Under-Coating Layer 170 parts of n-butyl alcohol in which 4 parts of polyvinyl butyral resin(Esrek BM-S, manufactured by Sekisui Chemical Co., Ltd.) was dissolved, 30 parts of an organic zirconium compound (acetyl acetone zirconium butylate), and 3 parts of a mixture of organic silane compounds ($\gamma$-aminopropyltrimethoxysilane) were mixed in turn and stirred to prepare a coating liquid for forming an under-coating layer.

This coating liquid was applied on the electroconductive support which was made of aluminum, which had a 84 mm diameter, and which was surface-roughened by the honing treatment. The coating liquid was dried by air at room temperature for five minutes. Then, the temperature of the electroconductive support was raised at 50° C. for 10 minutes. The electroconductive support was placed in a thermohygrostat condition of 85% RH (dew point: 47° C.) and 50° C., a process for promoting the moisture-curing was carried out for 20 minutes. Thereafter, the electroconductive support was placed in an hot air dryer and dried at 170° C. for 10 minutes to form an under-coating layer on the electroconductive support.

Formation of Charge Generating Layer

A mixture formed from charge generating materials, which were 15 parts of gallium chloride phthalocyanine, 10 parts of a vinyl chloride/vinyl acetate copolymer resin (VMCH, manufactured by Nippon Uniker Co., Ltd.), and 300 parts of n-butyl alcohol, was dispersed for 4 hours using a sandmill. The resulting dispersion liquid was applied to the under-coating layer by dipping and dried to form a charge generating layer with a thickness of 0.2 $\mu$m.

Formation of Charge Transporting Layer

Next, 4 parts of N,N'-diphenyl-N,N'-bis(3-methylphenyl)-[1,1'-biphenyl]-4,4'-diamine and 6 parts of a bisphenol Z polycarbonate resin (molecular weight of 40,000) were dissolved by adding 80 parts of chlorobenzene to prepare a solution. The resulting solution was applied to the charge generating layer and dried to form a charge transporting layer with a thickness of 20 Mm.

A laminate-type electrophotographic photosensitive member formed of three layers was prepared in this manner.

An electrophotographic photosensitive member of Comparative Example 3 was prepared as follows.

The electrophotographic photosensitive member of Comparative Example 3 was the same as the electrophotographic photosensitive layer prepared in Example 1 except that the charge generating layer was manufactured by the following process.

5 parts by weight of a butyral resin (XYHL, manufactured by UCC) was dissolved in 150 parts by weight of cyclohexanone. To this mixture was added 10 parts by weight of trisazo pigment shown by the following chemical formula. This mixture was dispersed in a ball mill for 48 hours. 210 parts by weight of cyclohexanone was further added to the resulting mixture and dispersed for 3 hours. The dispersed mixture was diluted in cyclohexanone while stirring so that the solid content was 1.8% by weight. The coating liquid for a charge generating layer which was prepared in this manner was applied to the above intermediate layer and dried at 130° C. for 20 minutes to form a charge generating layer with a thickness of 0.2 $\mu$m.

provided with an unillustrated control unit (control means) 8 for controlling these units (means)

The charging unit 2 is a scorotron-type charger whose charging potential is set to −700 V. The transfer charger 5 is a scorotron-type charger. A red LED (660 nm) was used as the light source of the light charge-removing unit 7.

Figure 3:
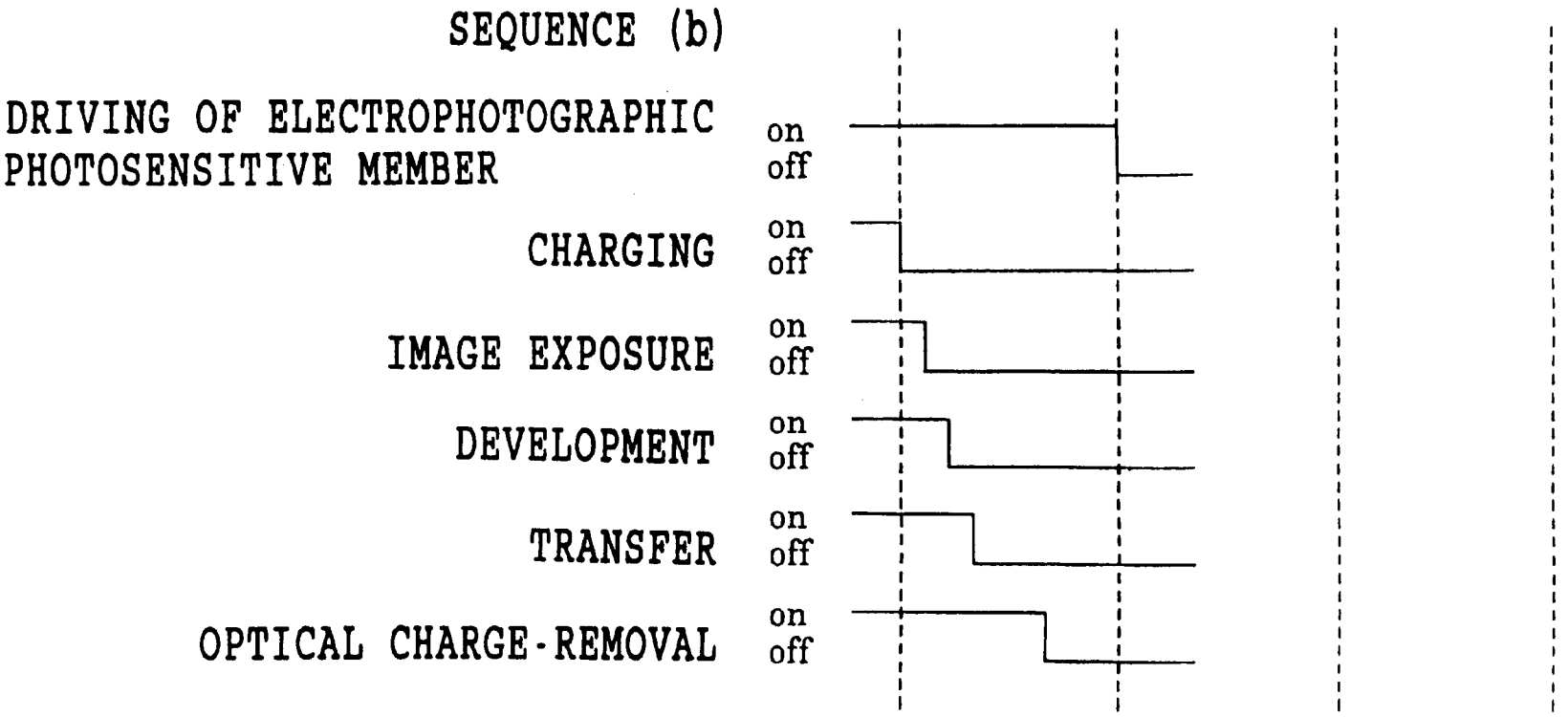
FIG. 3 is a view for explaining an embodiment of a control mode (a sequence of a comparative example) of a control mean.
Figure 4:
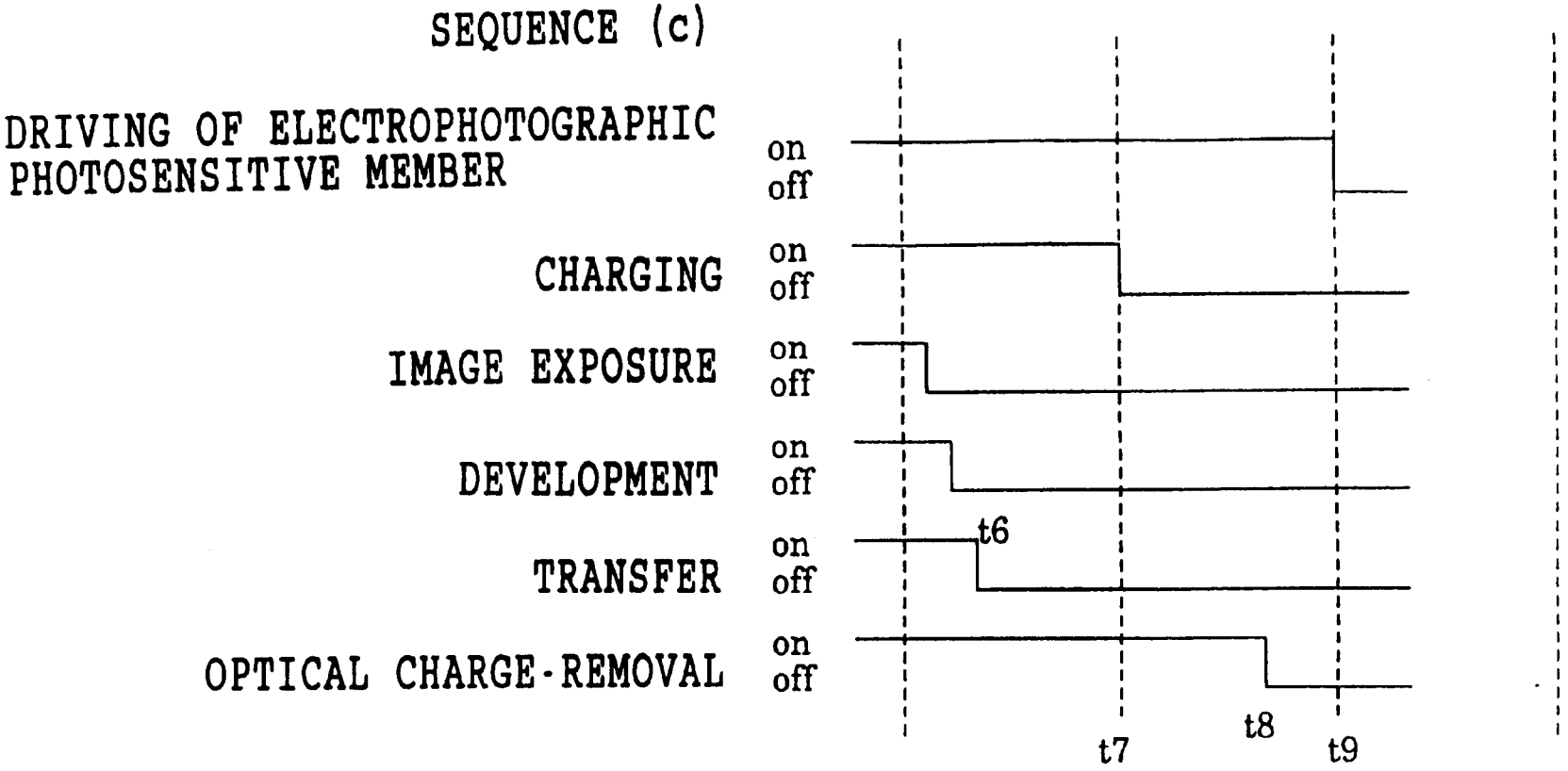
FIG. 4 is a view for explaining an embodiment of a control mode (a sequence of another comparative example) of a control means.

The control mode of the control unit is shown in Table 1. In Example 1, the sequence (a) shown in FIG. 2 was used. In Comparative Examples 1 to 3, the sequence (b) shown in FIG. 3 was used. However, in Comparative Example 2, the sequence (b) was not used in the image forming step of the first revolution of the electrophotographic photosensitive member (operation by idle rotation) after pushing of a copy button, and instead, the control mode was altered to the sequence used in the image forming process from the second revolution on in which the charge potential was stabilized. In Comparative Example 5, the sequence (c) shown in FIG. 4 was used. In FIGS. 2 to 4, each portion disposed between vertical lines represents a range passed by one revolution of the electrophotographic photosensitive member.

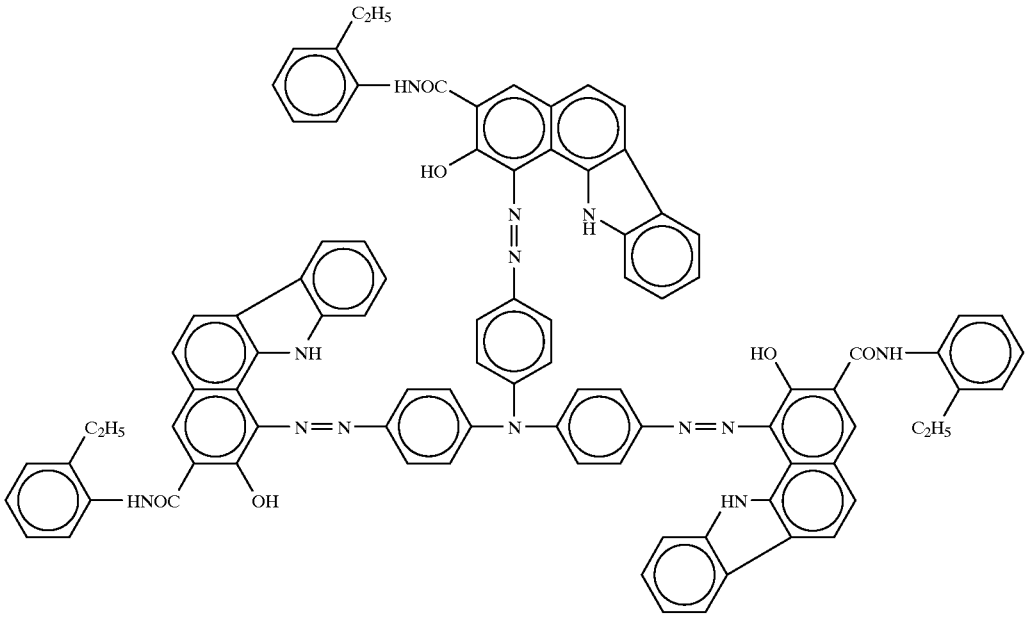

The image quality and electric characteristics of these electrophotographic photosensitive members were evaluated. The apparatuses used in the evaluation were as follows.

In Example 1 and Comparative Examples 1 to 3 and 5, a digital copying machine (Able 3300 having a process speed of 155 mm/sec and manufactured by Fuji Xerox Co., Ltd.) using the laminate-type electrophotographic photosensitive member as a drum having a diameter of 84 mm and a length of 340 mm were used.

This copying machine, as shown in FIG. 1, comprises a charger (charging means) 2, an image exposure unit (image exposure means) 3, a developing unit (developing means) 4, a transfer charging unit (transfer means) 5, a cleaning blade 6, and an light charge-removing unit (light charge-removing means) 7, which units are disposed in that order in the direction of rotation of a laminate-type electrophotographic photosensitive member 1. Further, the copying machine is In the copying machine used herein, the time required for one revolution of the drum of the electrophotographic photosensitive member is 1.702 seconds. The time required for the region of the electrophotographic photosensitive member, which region opposes the transfer unit eat the time when the operation of the transfer unit is stopped, to reach the light charge-removing unit which is running, is about 0.567 seconds. The time required for the region of the electrophotographic photosensitive member, which region opposes the transfer unit at the time when the operation of the transfer unit is stopped, to reach the charging unit which is running is about 1.135 seconds.

In the sequence (a) shown in FIG. 2 of Example 1, control was effected such that the region of the electrophotographic photosensitive member, which region opposed the transfer unit at the time (t1) when the operation of the transfer unit was stopped, reached the charging unit, which was running, in about 1.135 seconds (t2), the electrophotographic photosensitive member was made to rotate one more revolution while the charging unit was "on", and the charging unit was turned "off" at the time t3 about 2.837 seconds after the time t1. Further, control was effected such that the region of the electrophotographic photosensitive member, which region opposed the transfer unit at the time (t1) when the operation of the transfer unit was stopped, reached the light charge-removing unit, which was running, in about 0.567 seconds, the electrophotographic photosensitive member was made to rotate two more revolutions while the light charge-removing unit was "on", the light charge-removing unit was turned "off" at the time t4 about 3.971 seconds after the time t1, and the rotation of the electrophotographic photosensitive member was stopped at the time t5 about 0.567 seconds after the time t4.

In the sequence (b) shown in FIG. 3 of Comparative Examples 1 to 3, control was effected such that when the region of the electrophotographic photosensitive member, which region opposed the charging unit at the time when the operation of the charging unit was stopped, reached each of the image exposure unit, developing unit, transfer unit, and light charge-removing unit, the operation of each unit was stopped respectively. Further, the driving of the electrophotographic photosensitive member was controlled such that the electrophotographic photosensitive member was stopped after being rotated further after the operation of the charging unit was stopped.

In the sequence (c) shown in FIG. 4 of Comparative Example 5, control was effected such that the operation of the charger unit was stopped at a time t7 which was about 1.135 seconds after a time t6 and which was a time at which a region of the electrophotographic photosensitive member, which region opposed the transfer unit at the time t6 at which the operation of the transfer unit was stopped, reached the charger unit. Further, control was effected such that the region of the electrophotographic photosensitive member, which region opposed the transfer unit at the time (t6) when the operation of the transfer unit was stopped, reached the light charge-removing unit in about 0.567 seconds, the electrophotographic photosensitive member was made to rotate one more revolution while the light charge-removing unit was "on", the light charge-removing unit was turned "off" at the time t8 about 2.269 seconds after the time t6, and the rotation of the electrophotographic photosensitive member was stopped at the time t9 about 0.567 seconds after the time t8.

In Example 2 and Comparative Example 4, the laminate-type electrophotographic photosensitive member was formed as a drum with a diameter of 30 mm and a length of 340 mm, and a digital copying machine (Able 3321, manufactured by Fuji Xerox co., Ltd.) was used. This copying machine had almost the same structure as the copying machine shown in FIG. 1, except that the light charge-removing unit 7 was not provided.

In this copying machine, the charging unit 2 is a contact-type roller charger whose charging potential is set to −500 V. T he transfer charger 5 is a contact-type roller charger.

Figure 6:
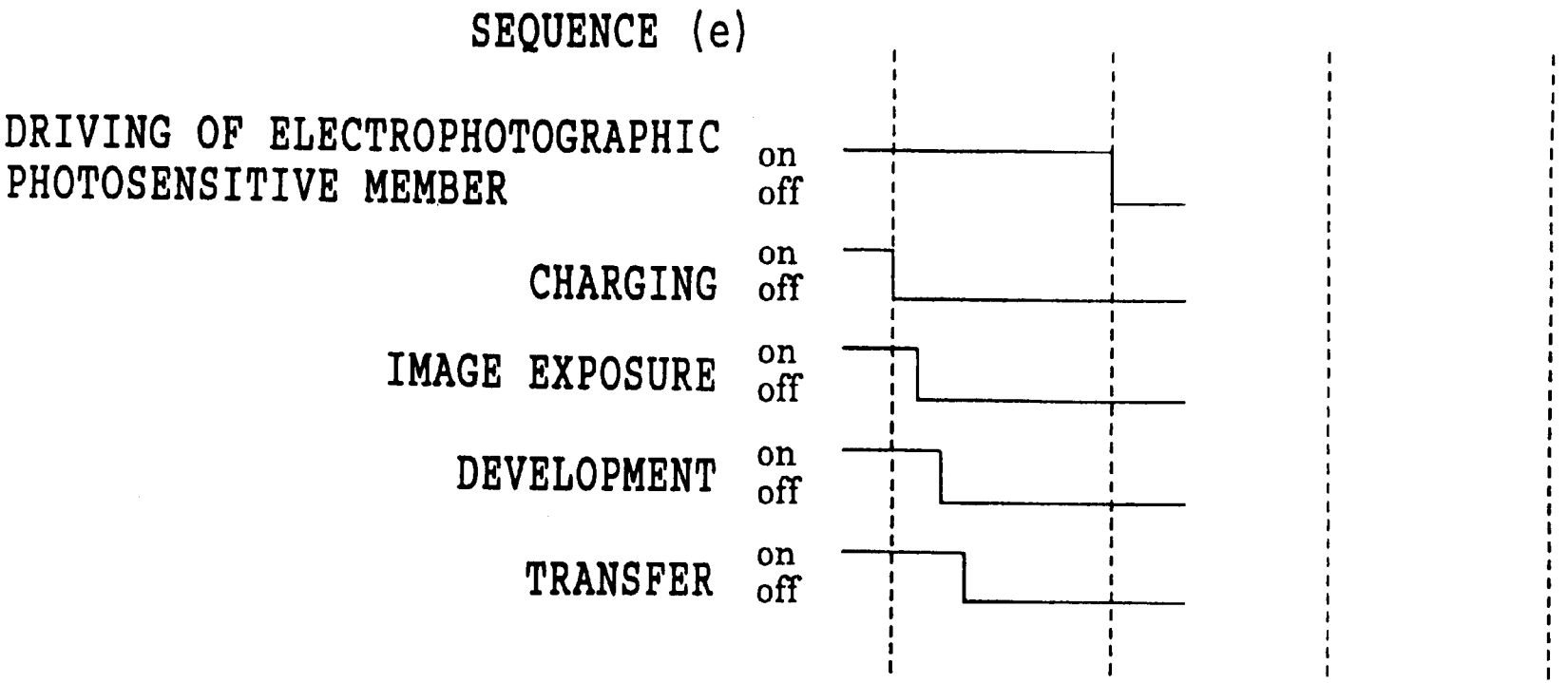
FIG. 6 is a view for explaining an embodiment of a control mode (a sequence of yet another comparative example) of a control means.

The control mode of the control unit is shown in Table 1. In Example 2, the sequence (d) shown in FIG. 5 was used. In Comparative Example 4, the sequence (e) shown in FIG. 6 was used. In FIGS. 5 and 6, each portion disposed between vertical lines represents a range passed by one revolution of the electrophotographic photosensitive member.

In the copying machine used here, the time required for one revolution of the electrophotographic photosensitive member drum was 0.608 seconds. The time required for the region of the electrophotographic photosensitive member, which region opposed the transfer unit at the time when the op operation of the transfer unit was stopped, to reach the charging unit was about 0.405 seconds.

In the sequence (d) shown in FIG. 5 of Example 2, control was effected such that the region of the eloectrophotographic photosensitive member, which region opposed the transfer unit at the time (t10) when the operation of the transfer unit was stopped, reached the charging unit at the time t11 about 0.405 seconds after the time t10, the electrophotographic photosensitive member was made to rotate one more revolution while the charging unit was "on", and the charging unit was turned "off" at the time t12 about 1.013 seconds after the time t10. Further, the rotation of the electrophotographic photosensitive member was stopped at the time t13 about 0.405 seconds after the time t12.

In the sequence (e) shown in FIG. 6 of Comparative Example 4, control was effected such that when the region of the electrophotographic photosensitive member, which region opposed the charging unit at the time when the operation of the charging unit was stopped, reached each of the image exposure unit, developing unit, and transfer unit, the operation of each unit was stopped respectively. Further, the driving of the electrophotographic photosensitive member was controlled such that the electrophotographic photosensitive member was stopped after being rotated one more revolution alter the operation of the charging unit was stopped.

The amount of light for exposure was adjusted in all Examples and Comparative Examples before the test so that the potential ($V_L$) of the exposed portion was −150 V.

Two of the same copying machines were prepared: one for evaluating the electric characteristics and one for evaluating the image quality, and the experiments were conducted separately.

The evaluation of the electric characteristics was performed as follows. A known potential measuring device was electrically connected to the copying machine, and copying operation was started to make 10 consecutive copies and was then suspended for 10 minutes. These operations were repeated until 100 copies were made. Then, in the same way as above, the copying operation was suspended for 10 minutes. Thereafter, 10 consecutive copies were made. At this time, a voltage variation between the operations for the first copy and second copy was measured. Thereafter, a continuous copying operation was performed to make 10,000 copies whose image qualities were evaluated. After the 10,000 copies were made, operation was suspended and the copying machine was allowed to stand for one day and night (about 24 hours). Then, 10 consecutive copies were made, the image qualities thereof were evaluated, and a voltage variation between the operations for the first copy and second copy was measured in the same manner as above. As for the level of the evaluation, a value of +4 or less shows a level which dose not present problems in practice. The results are shown in Table 1.

The evaluation of image quality was performed at a temperature of 10° C. and a relative humidity of 20% as follows.

For evaluating the image quality, 5 mm square letters, 25 mm square letters, and a 30 mm×30 mm solid black square were formed in a line on the first half of each copy. In the second half of each copy, sampling was carried out by using a uniform test chart having halftone dot densities of one dot on one off on half of the test chart.

For the evaluation of ghosting, the halftones in the second half of the copy were visually inspected, and were rated 0 in the case where nothing was observed, were rated 5 in the case where ghosting clearly appeared judging from the difference in density, and were rated 3 in the case where slight ghosting observed. Ratings between the above ratings (e.g., 1, 2, 4) were also given. A standard grade sample showing these ratings was prepared in advance and used for the evaluation. The results are shown in Table 1 in which negative ghosting and positive ghosting are symbolized as "N" and "P" respectively. A rating of N1, P1, or zero means a level which dose not present problems in practice.

The evaluation of image quality was performed by the following procedures. Copying operation was started to make 10 consecutive copies and was then suspended for 10 minutes. These operations were repeated until 100 copies were made. Then, in the same way as above, the copying operation was suspended for 10 minutes, and thereafter, 10 consecutive copies were made. At this time, ghosting of the first, second, and third copies was evaluated. Thereafter, a continuous copying operation was performed to make 10,000 copies whose image qualities were evaluated. After the 10,000 copies were made, operation was suspended and the copying machine was allowed to stand for one day and night (about 24 hours). Then, 10 consecutive copies were made, and ghosting of the first, second, and third copies were evaluated in the same manner as above.

speed processing, the generation of negative or positive ghosting and the like can be suppressed, and variations in the electric characteristics and image qualities between the operations for the first copy and the second copy are suppressed, whereby images of high quality can be produced quickly and simply.

In contrast with the present invention, in the case of the Comparative Examples (Comparative Examples 1, 2, 4, 5), after a copy cycle is completed and the transfer step is finished, the last position of the electrophotographic photosensitive member at the time of completion of the transfer step is not rotated one or more cycles, that is, the electrophotographic photosensitive member is not rotated one or more revolutions, and charging treatment using the charging means (charging unit) is not carried out, and the copy cycle is terminated with electrons remaining in the charge generating layer. It is clear that in these Comparative Examples, there is negative ghosting and the variations in the electric characteristics between the first and second copying operations are great, and hence, excellent images cannot be obtained. In the case of Comparative Example 2, the generation of negative ghosting and the variations in the electric characteristics are slightly reduced compared with the case of Comparative Example 1. However, the level of Comparative Example 2 is far from that of the present invention. Further, idle rotation is required at the start of the copying operation in this case. Therefore, the method of this Comparative Example is undesirable because high speed, copying operation cannot be realized. In addition, because a phthalocyanine compound is not used as the charge generating material in Comparative Example 3, the photosensitivity is low and it is clear that Comparative Example 3 is inferior to the present invention.

The above-described conventional problems can be solved by the present invention. Further, the present invention can provide an electrophotographic apparatus and an

TABLE 1

| | Control mode (terminating sequence) | $V_L$ variation (V) in copy cycle t-2: 101st–102nd copies | $V_L$ variation (V) in copy cycle t-2: 10001st–1002nd copies | Ghosting after 100th copy: 101st copy | Ghosting after 100th copy: 102nd copy | Ghosting after 100th copy: 103rd copy | Ghosting after 10000th copy: 10001st copy | Ghosting after 10000th copy: 10002nd copy | Ghosting after 10000th copy: 10003rd copy | Photosensitivity (mJ/m$^2$) *1 |
|---|---|---|---|---|---|---|---|---|---|---|
| Example 1 | a | 0 | +2 | 0 | 0 | 0 | N1 | 0 | 0 | 4.8 |
| Example 2 | d | 0 | +3 | 0 | 0 | 0 | N1 | 0 | 0 | — |
| Comparative Example 1 | b | +5 | +3 | N2 | N1 | 0 | N3 | N2 | N1 | — |
| Comparative Example 2 | b | +3 | +6 | N1 | 0 | 0 | N2 | N1 | 0 | — |
| Comparative Example 3 | b | 0 | +1 | 0 | 0 | 0 | 0 | 0 | 0 | 6.9 |
| Comparative Example 4 | e | +7 | +9 | N3 | N2 | N1 | N3 | N3 | N2 | — |
| Comparative Example 5 | c | +5 | +6 | N2 | N1 | 0 | N2 | N1 | 0 | — |

*1 The photosensitivity indicates the quantity (mJ/m$^2$) of light needed for exposure under the condition that the voltage changed from −700 V to −150 V As is clear from the results shown in Table 1, if the electrophotographic apparatus of the present invention is used, specifically, in the image forming method of the present invention, idle rotation is not required to ensure high image forming method for reverse developing which require no idle rotation, make high speed processing possible, suppress the generation of negative and positive ghosting, and suppress variations in electric characteristics and in an image densities between first and second copy cycles, thereby enabling images of high quality to be prepared quickly and simply.

What is claimed is:

1. An electrophotographic apparatus comprising:

an electrophotographic photosensitive member provided with a photosensitive layer, which contains a phthalocyanine compound, on an electroconductive support;

charging means for charging the electrophotographic photosensitive member, the charging means having at least an electrically on state;

image exposure means for forming an image on the electrophotographic photosensitive member by exposure;

developing means for reverse-developing the image on the electrophotographic photosensitive member;

transfer means for transferring the image formed on the electrophotographic photosensitive member, the transfer means having an electrically on state and an electrically off state; and control means for stopping rotation of said electrophotographic photosensitive member;

the electrophotographic photosensitive member rotating such that the photosensitive layer passes the charging means, the image exposure means, the developing means and the transfer means, and wherein the control means stops rotation of the electrophotographic photosensitive member after a region of the photosensitive layer that opposes said transfer means at a time when said transfer means is placed in the electrically off state passes, by at least one revolution, said charging means which is in the electrically on state.

2. An electrophotographic apparatus according to claim 1, wherein said photosensitive layer comprises a charge generating layer, which contains a phthalocyanine compound, and a charge transporting layer.

3. An electrophotographic apparatus according to claim 1, wherein at least one of said charging means; and said transfer means is a contact-type charger.

4. An electrophotographic apparatus according to claim 1, further comprising light charge-removing means between said transfer means and said charging means, the light charge-removing means having at least an electrically on state, said control means effecting control such that the region of the photosensitive layer that opposes said transfer means at the time when said transfer means is placed in the electrically off state passes, by at least one revolution, a position opposing said light charge-removing means which is in the electrically on state.

5. An electrophotographic apparatus according to claim 4, wherein at least one of said charging means and said transfer means is a contact-type charger.

6. An electrophotographic apparatus according to claim 1, wherein said phthalocyanine compound is at least one compound selected from the group of consisting of halogenated gallium phthalocyanine, halogenated tin phthalocyanine, hydroxy gallium phthalocyanine, oxytitanyl phthalocyanine, halogenated indium phthalocyanine, vanadyl phthalocyanine, and non-metal phthalocyanine.

7. An image forming method comprising:

a charging step of charging, by using a charging means that has at least an electrically on state, an electrophotographic photosensitive member provided with a photosensitive layer, which contains a phthalocyanine compound, on an electroconductive support;

a latent image forming step of effecting image exposure by an image exposure means to form an electrostatic latent image;

a developing step of making the electrostatic latent image visible by a reverse-developing means to form an image on the electrophotographic photosensitive member;

and a transfer step of transferring the image formed on the electrophotographic photosensitive member by a transfer means that has an electrically on state and an electrically off state;

wherein the electrophotographic photosensitive member rotates such that the photosensitive layer passes the charging means, the image exposure means the developing means and the transfer means, and wherein the rotation of the electrophotographic photosensitive member is stopped after a region of the photosensitive layer that opposes the transfer means at a time when the transfer means is placed in the electrically off state passes, by at least one revolution, a position opposing the charging means which is in the electrically on state.

8. An image forming method according to claim 7, wherein said photosensitive layer comprises a charge generating layer, which contains a phthalocyanine compound, and a charge transporting layer.

9. An image forming method according to claim 7, wherein at least one of said charging step and said transfer step is performed by using a contact-type charger.

10. An image forming method according to claim 7, further comprising a light charge-removing step, between said transfer step and said charging step, to optically remove charge from the electrophotographic, photosensitive member by a light charge-removing means that has at least an electrically on state, wherein the region of the photosensitive layer that opposes the transfer means at the time when the transfer means is placed in the electrically off state passes, by at least one revolution, a position opposing the light charge-removing means which is in the electrically on state.

11. An image forming method according to claim 10, wherein at least one of said charging step and said transfer step is performed by using a contact-type charger.

* * * * *